United States Patent [19]

Jack et al.

[11] 4,106,254

[45] Aug. 15, 1978

[54] ASSEMBLY MITER JOINT

[76] Inventors: Clyde A. Jack, 131 Ford St., Youngsville, Pa. 16371; Evander E. Dargan, P.O. Box 826, Florence, S.C. 29501

[21] Appl. No.: 757,371

[22] Filed: Jan. 6, 1977

[51] Int. Cl.[2] ..... E04C 1/04

[52] U.S. Cl. ..... 52/574; 52/595; 217/65; 217/96

[58] Field of Search ..... 52/248, 436, 423, 192, 52/193, 730, 731, 595, 608, 574; 403/401; 217/96, 65

[56] References Cited

U.S. PATENT DOCUMENTS

| | | | |
|---|---|---|---|
| 589,836 | 9/1897 | Koll | 217/96 |
| 756,261 | 5/1904 | Miller | 217/96 |
| 2,457,982 | 1/1949 | Deichmann | 52/270 |
| 2,877,506 | 3/1959 | Almoslino | 52/574 |

FOREIGN PATENT DOCUMENTS

| | | | |
|---|---|---|---|
| 331,379 | 11/1935 | Italy | 52/248 |
| 443,130 | 2/1936 | United Kingdom | 52/248 |

*Primary Examiner*—James L. Ridgill, Jr.

*Attorney, Agent, or Firm*—Richards, Shefte & Pinckney

[57] ABSTRACT

A lengthwise miter joint and boards for forming it have mating effective V-tongue and -groove portions in their miter faces for positive registered alignment of the joint while it is being permanently fastened as by gluing, nailing, etc. The tongue and groove portions are centered widthwise of their respective miter faces so that the same boards may be selectively assembled either in angular or aligned relation to each other. The effective included angles of the tongue and groove provide registered angular assembly of the joint with a single rectilinear motion of one board perpendicular to the flat sides of that board. The effective V-tongues and -grooves characteristically provide relatively strong shapes to both boards in a joint.

3 Claims, 12 Drawing Figures

ASSEMBLY MITER JOINT

BACKGROUND OF THE INVENTION

Plain miter joints are extremely difficult to assemble permanently in registered alignment unless a holding fixture is used. Such fixtures are impractical for use other than "in-shop," particularly for long boards for hollow beams, boxes, and columns. Many modifications have been made to the miter surfaces to facilitate such miter joint assembly, as seen in U.S. Pat. Nos. 909,080 and 1,089,360, on page 9 of a current Anthe Machine Works catalog, and on page 1447 of Websters Third New International Dictionary of the English Language Unabridged, Copyright 1966. However, none of these prior art arrangements have the advantages of strength, non-locking assembly, ease of assembly, and diversity of assembly offered by the present invention.

SUMMARY OF THE INVENTION

The assembly miter joints of the present invention are especially useful where prefabricated boards with mitered side edges are supplied to the field for on-site assembly as hollow beams, columns, boxing, and flat paneling.

Briefly, the lengthwise miter joints provided by this invention are characterized by an effectively V-shaped mating tongue and groove, each located at the widthwise center of its respective miter surface and extending lengthwise thereof, and each symmetrical about that center at the mating portions of the tongue and groove for selective assembly in angular and aligned board disposition. The included angles of the tongue and groove are selected to allow perfectly mating assembly in the angular position by a single rectilinear motion of one board perpendicular to its own flat surface.

The boards of this invention are preferably of basically isosceles trapezoid cross-section for selective assembly into miter joints in either hollow or flat cross-sectional configuration, one mitered side edge of each board having a tongue and the other a groove as herebefore described, for ready assembly of prefabricated boards into various cross-sectional shapes such as angles, hollow beams, boxes, flat sections, and combinations thereof. Preferably the effective included angles of the effectively V-shaped tongues and grooves are approximately equal to, but not less than, the interior included angle between the flat sides of boards assembled in angular relation, for assembly or disassembly without disturbing adjoining boards while retaining maximum registration capability.

The preferred embodiment of this invention provides a tongue of height approximately 20% of the basic board thickness to reap the practical advantage of a sturdy tongue combined with a corresponding groove of minimum weakening effect on its board edge.

DETAILED DESCRIPTION OF THE PREFERRED EMBODIMENTS

Figure 1:
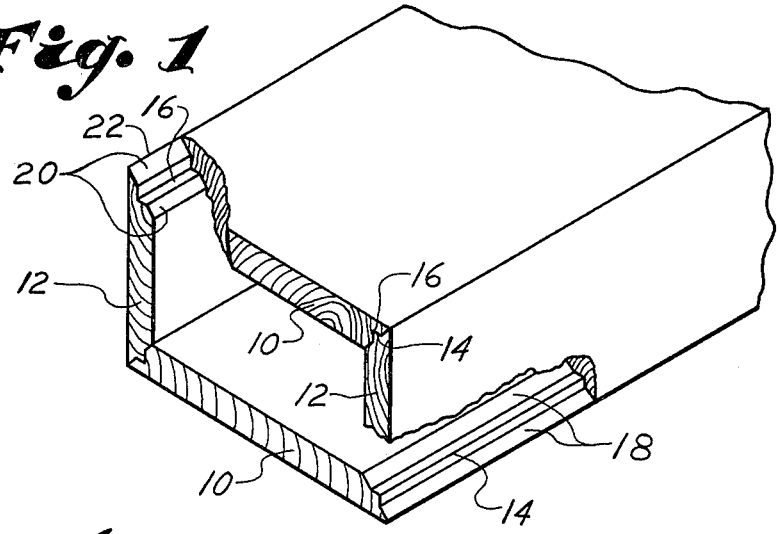
FIG. 1 is a perspective view of a typical hollow beam embodying four joints and four boards of the present invention.

In the illustrated embodiments, a typical box section formed from wooden boards and with miter joints according to the present invention is shown in FIG. 1. Such hollow box and beam configurations are typical of the uses for the miter joints and mitered boards of this invention, and one or two of the boards may be omitted to form U- or L-sections as needed for diverse purposes. The same boards may be combined as in FIG. 3*a* to form flat panel surfaces, and the flat and angular assembly configurations may be combined for more complicated boxing-in purposes.

Figure 2:
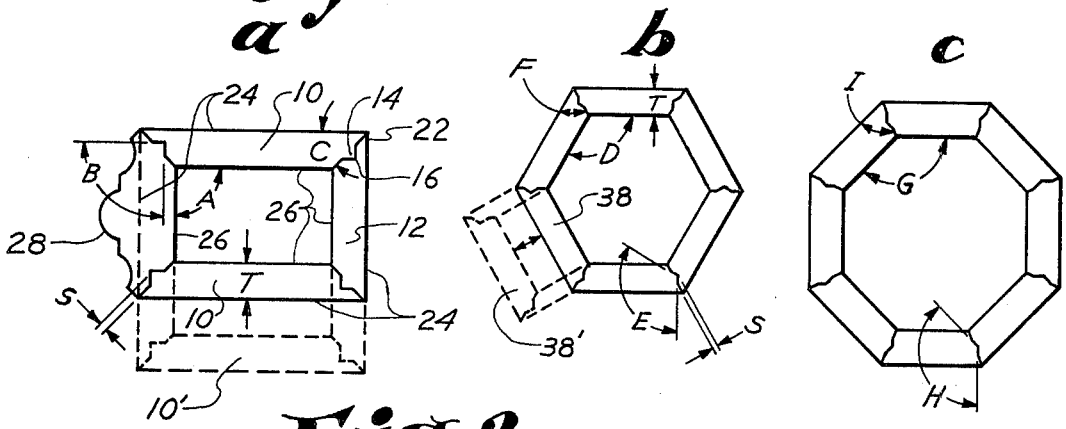
FIGS. 2*a, b,* and *c* show the cross-sectional shapes of three typical hollow beam embodiments of the invention.

In detail, boards 10 and 12, wide and narrow respectively, as seen in FIGS. 1 and 2*a,* are typically formed from wood, though other building materials such as plastic, particle board, sheet rock, or otherwise could be used. The miter joints used to join these boards at their edges are characterized by the tongues 14 and grooves 16, which in simplest form would have plain 90° V-shape in cross-section, as shown in FIG. 2*a,* for right angle miter joints (where the miter joint angle A equals 90°). It is to be understood that the tongue 14 must be slightly smaller than the groove 16, so that the miter surfaces 18 and 20 on tongued and grooved board edges respectively, may fit fully in contact with each other at assembly. Within normal manufacturing practices, this slightly loose fit between tongue and groove provides sufficient alignment capability for assembling the miter joints with neat appearance and sound construction.

It is advantageous that the same boards as shown in FIGS. 1 and 2*a* should be capable of assembly into aligned, flat, or paneled configuraton as shown in FIG. 3*a*; therefore, the tongues 14 and the grooves 16 are located centered in the width of their respective mitered surfaces 18 and 20. Also, the tongues 14 and grooves 16 are each in the form of isosceles triangles constructed at the widthwise centers of surfaces 18 and 20 as defined by the dimensions W and W/2 in FIG. 3*a* for example, that is, the tongues and grooves are symmetrical about these centers for interchangeable assembly in angular and flat board relationships.

It is frequently desirable for one of the boards of a miter assembly to be assembled or disassembled after the other board or boards have been permanently fixed in place, and it is desirable for this purpose to move the loose board into and out of assembly with a single rectilinear movement perpendicular to the flat sides of the board, as indicated by the board 10′ as shown removed in broken lines in FIG. 2*a.* To permit such movement, and at the same time retain the maximum alignment capabilities of the tongue and groove, the tongue and groove included angle B is preferably 90°, because an angle B less than 90° would interfere with the free assembly just mentioned, and an angle greater than 90° would provide less than the optimum alignment capability. As a general rule, the tongue and groove included angles B must be equal to or greater than the miter joint angle A, and the miter surface angle C must equal half the miter joint angle A.

Conventional tongues and grooves frequently have essentially parallel sides, which when assembled together have a locking characteristic rendering them subject to damage (particularly by splitting or breaking off the tongue or a board edge adjacent the groove) when any misalignment occurs during assembly of such tongues and grooves. It is notable that the V-tongues and grooves of the present invention have none of this self-locking characteristic and are damage-free from that standpoint. However, in order that the board edge 22 at the acute angle C side of miter surface 20, be of sufficient thickness for damage-free use, it is desirable that the depth S of the grooves 16 be approximately 20% of the thickness T of the basic shape of the miter joint boards.

The just-mentioned basic shape of the miter joint boards refers to the isosceles trapezoid cross-section of the boards 10 and 12 as shown in FIG. 2*a*, the long and shorter, or outer and inner, parallel sides 24 and 26 respectively of the trapezoid being formed by the real or imaginary lines joining the wider spaced and closer spaced ends of the isosceles miter sides or surfaces 18 and 20. The miter joint boards may have any suitable configuration in modification of their outer or inner sides 24 and 26, respectively, such as the fancy side 28, without lessening their utility.

Figure 4:
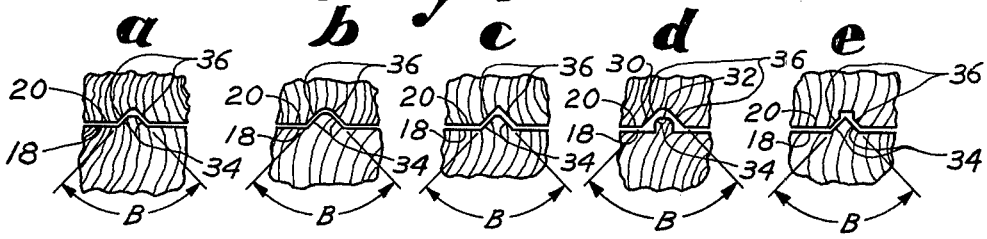
FIGS. 4*a, b, c, d,* and *e* show the cross-sectional shapes of various effective V-shapes for tongues and grooves.

As a practical matter, it may be desirable to depart from the plain V-tongue and -groove configurations as shown in FIG. 2*a* for ease of manufacturing or other reasons, and various other configurations might well be used to the same effect. A variety of modified, but effectively V-shaped tongue and groove arrangements are shown in FIGS. 4*a*–4*e*. It will be understood that these joints are shown slightly separated for clarity, but in use, the mitered surfaces 18 and 20 would be placed in intimate contact. For all the configurations of FIG. 4, which are intended for use in 90° miter joints, the angles B should in each case be effectively 90° or more, just as for FIG. 2*a*. The "effective" tongue and groove angle is that at which the mating surfaces contact each other, and as shown in FIG. 4*d*, the effective angle may be determined by the shape of one member, as at groove 30 in this case, where tongue 32 has no obvious 90° included angle B. Otherwise, so long as tongue and groove are non-interfering when the miter joint boards are assembled in both angular and aligned configurations, their shapes are immaterial except at the contact surfaces 34 and 36 respectively of the tongues and grooves of FIG. 4. It is conceivable that multiple tongues and grooves might be formed lengthwise of the miter surface with equal utility, and without departing from the present concept.

Other miter joint angles such as D in FIG. 2*b* or G in FIG. 2*c* may be desirable. For any miter joint angle, the tongue and groove angle should be equal or greater, and the miter surface angle such as F and I should equal $\frac{1}{2}$ of the miter angle such as D and G. Thus, in FIG. 2*b*, $2F=D\leqq E$, and in FIG. 2*c*, $2I=G\leqq H$. As a practical matter, the various angles called out should nominally be $A=90°$, $B=90°$, $C=45°$; $D=120°$, $E=120°$, $F=60°$; $G=135°$, $H=135°$, $I=67.5°$.

As illustrated by the broken lines shown in FIG. 2*b*, a single side 38 of the hollow hexagonal assembly may be removed without disturbing the other sides, as indicated by 38'. A similar condition prevails in the hollow octagonal assembly of FIG. 2*c*.

Figure 3:
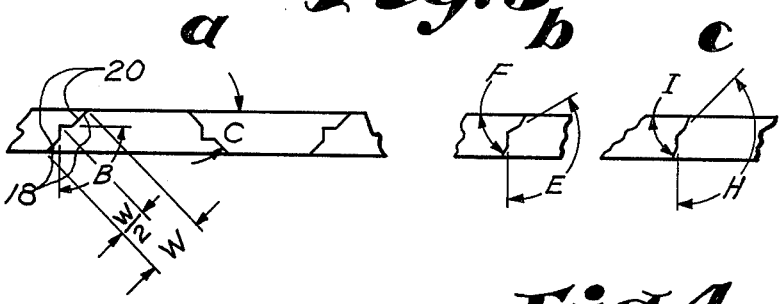
FIGS. 3*a, b,* and *c* show the cross-sectional disposition of the board shapes of FIGS. 2*a, b,* and *c* respectively arranged in aligned disposition as for paneling.

Also, as shown in FIG. 3, tongued and grooved miter joint boards according to the above disclosure may be assembled in aligned relationship, and the miter boards may always be freely removed from the assembly in the direction of the wider flat side thereof, and any miter board prepared for a 90° or greater miter joint angle may be removed edgewise from the end position in such an assembly.

The various tongue and groove configurations of FIG. 4, or others, may equally well be applied to tongues and grooves of various effective included angles suitable for other miter joint angles.

The invention as disclosed above provides means by which prefabricated miter joint boards may be assembled in a variety of configurations, and by which the joints may be readily held in registered alignment for permanent assembly by means of nailing, gluing, screwing, stapling, or otherwise fastening the joints, without problems of the miter surfaces slipping out of register. This is particularly important for lengthy miter joints, where warpage of the boards causes special problems both with alignment and with the tendency of conventional tongue and groove construction to split off tongues or board edges when such tongues and grooves are driven into engagement.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

We claim:

1. Wooden boards for intimately contacting lengthwise miter joint assembly in pluralities thereof for selectively forming angular, U, hollow box or beam, and flat cross-sectional assembly configurations thereof, comprising opposite side edges extending between the parallel flat sides of said boards, said side edges being suitably shaped to form miter joints, forming basically isosceles trapezoid cross-sections of said boards with the parallel flat sides thereof, having tongues and grooves thereat for mating contact in said joints for causing registered alignment thereof during said intimately contacting assembly thereof, and having one of said tongues in one said edge of each said board and one of said grooves in the other said edge thereof, each of said tongues and grooves being of effective V-shape, of symmetrical shape in cross-section at the mating portions thereof about the widthwise center of its respective miter surface, of effective included angle in cross-section at the mating portions thereof permitting said assembly and disassembly of any said board to and from two said boards each in said intimately contacting assembly therewith at said opposite side edges thereof by a single rectilinear board motion of said any said board perpendicular to the flat sides thereof, and of lengthwise extent along its respective said board.

2. Wooden boards according to claim 1, and characterized further in that said included angles are approximately equal to, but not less than, the interior included angle in cross-section between the flat sides of two said boards assembled in angular relation.

3. Wooden boards according to claim 1 and characterized further in that said tongues and grooves are of height and depth respectively approximately 20% of board thickness.

* * * * *